US009611702B2

(12) United States Patent
Mueller et al.

(10) Patent No.: US 9,611,702 B2
(45) Date of Patent: Apr. 4, 2017

(54) WIRED PIPE EROSION REDUCTION

(71) Applicants: Stephan Mueller, Hannover (DE); Rene Schulz, Hambühren (DE); Robert Buda, Celle (DE); Henning Rahn, Celle (DE)

(72) Inventors: Stephan Mueller, Hannover (DE); Rene Schulz, Hambühren (DE); Robert Buda, Celle (DE); Henning Rahn, Celle (DE)

(73) Assignee: BAKER HUGHES INCORPORATED, Houston, TX (US)

( * ) Notice: Subject to any disclaimer, the term of this patent is extended or adjusted under 35 U.S.C. 154(b) by 172 days.

(21) Appl. No.: 14/161,885

(22) Filed: Jan. 23, 2014

(65) Prior Publication Data

US 2015/0204143 A1 Jul. 23, 2015

(51) Int. Cl.
*E21B 17/00* (2006.01)

(52) U.S. Cl.
CPC ..... *E21B 17/003* (2013.01)

(58) Field of Classification Search
CPC ..... E21B 17/0003
See application file for complete search history.

(56) References Cited

U.S. PATENT DOCUMENTS

| | | | | |
|---|---|---|---|---|
| 3,624,760 | A * | 11/1971 | Bodine | E02D 7/18 175/171 |
| 2004/0244964 | A1 | 12/2004 | Hall et al. | |
| 2005/0150653 | A1 | 7/2005 | Hall et al. | |
| 2007/0159351 | A1* | 7/2007 | Madhavan | E21B 17/003 340/855.1 |
| 2007/0169929 | A1 | 7/2007 | Hall et al. | |
| 2008/0106433 | A1 | 5/2008 | Madhavan et al. | |
| 2012/0111555 | A1* | 5/2012 | Leveau | E21B 17/028 166/65.1 |

FOREIGN PATENT DOCUMENTS

EP 2430281 B1 9/2013

OTHER PUBLICATIONS

Pixton,D., "Very High—Speed Drill String Communications Network," DOE Final Technical Report, p. 1-59, 2005.

Notification of Transmittal of the International Search Report and the Written Opinion of the International Searching Authority, or the Declaration; PCT/US2015/012339, May 1, 2015, 11 pages.

* cited by examiner

*Primary Examiner* — Giovanna C Wright
(74) *Attorney, Agent, or Firm* — Cantor Colburn LLP

(57) ABSTRACT

A wired pipe segment includes an inner bore extending through the wired pipe segment and a transmission line channel forming a channel from outside the wired pipe segment to the inner bore and including an inlet into the inner bore. The inner bore includes a pocket formed in the inner bore proximate the inlet and an insert is disposed in the pocket that substantially fills the pocket.

7 Claims, 5 Drawing Sheets

WIRED PIPE EROSION REDUCTION

BACKGROUND OF THE INVENTION

During subterranean drilling and completion operations, a pipe or other conduit is lowered into a borehole in an earth formation during or after drilling operations. Such pipes are generally configured as multiple pipe segments to form a "string", such as a drill string or production string. As the string is lowered into the borehole, additional pipe segments are coupled to the string by various connection mechanisms, such as threaded couplings.

Various power and/or communication signals may be transmitted through the pipe segments via a "wired pipe" configuration. Such configurations include electrical, optical or other conductors extending along the length of selected pipe segments or string segments. The conductors are operably connected between pipe segments by a variety of configurations.

One such configuration includes a threaded male-female configuration often referred to as a pin box connection. The pin box connection includes a male member, i.e., a "pin end" that includes an exterior threaded portion, and a female member, i.e., a "box end", that includes an interior threaded portion and is configured to receive the pin in a threaded connection.

Some wired pipe configurations include a transmission device mounted on the tip of the pin end as well as in the box end. The transmission device, or "coupler," can transmit power, data or both to an adjacent coupler. The coupler in the pin end is typically connected via a coaxial cable or other means to the coupler in the box end. In such cases, if the transmission lines are slack in the pipe segment, they may be damaged by fluids and debris flowing through the pipe segment.

BRIEF DESCRIPTION OF THE INVENTION

Disclosed herein is a wired pipe segment includes an inner bore extending through the wired pipe segment and a transmission line channel forming a channel from outside the wired pipe segment to the inner bore and including an inlet into the inner bore. The inner bore includes a pocket formed in the inner bore proximate the inlet and an insert is disposed in the pocket that substantially fills the pocket.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of one or more embodiments of the disclosed apparatus and method are presented herein by way of example and not limitation with reference to the Figures.

Figure 1:
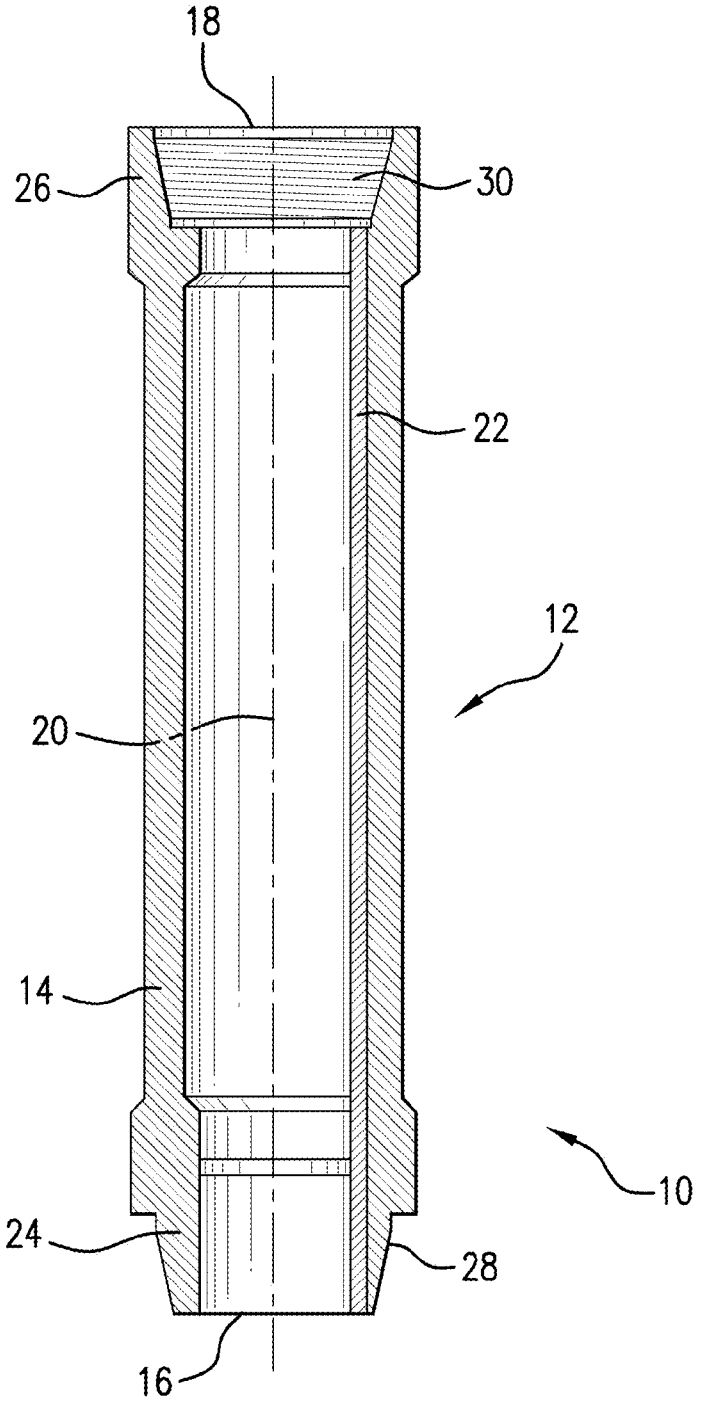
FIG. 1 depicts an exemplary embodiment of a wired pipe segment of a well drilling and/or logging system.

Referring to FIG. 1, an exemplary embodiment of a portion of a well drilling, logging and/or production system 10 includes a conduit or string of drill pipe segments 14 (generally denoted as string 12), such as a drillstring or production string, that is configured to be disposed in a borehole for performing operations such as drilling the borehole, making measurements of properties of the borehole and/or the surrounding formation downhole, or facilitating gas or liquid production.

For example, during drilling operations, drilling fluid or drilling "mud" is introduced into the string 12 from a source such as a mud tank or "pit" and is circulated under pressure through the string, for example via one or more mud pumps. The drilling fluid passes into the string and is discharged at the bottom of the borehole through an opening in a drill bit located at the downhole end of the string. The drilling fluid circulates uphole between the string and the borehole wall and is discharged into the mud tank or other location.

The wired pipe segment 14 has an uphole end 18 and a downhole end 16. As described herein, "uphole" refers to a location near the point where the drilling started relative to a reference location when the segment 14 is disposed in a borehole, and "downhole" refers to a location away from the point where the drilling started along the borehole relative to the reference location. It shall be understood that the uphole end 18 could be below the downhole end 16 without departing from the scope of the disclosure herein. In this same vein, as a plurality of segments are joined to form a string, the directions related to up and downhole described may also refer to the resultant string.

At least an inner bore or other conduit 20 extends along the length of each segment 14 to allow drilling mud or other fluids to flow therethrough. A transmission line 22 is located within the inner bore 20 of segment 14. In one embodiment, the transmission line enters the inner bore 20 via an inlet as described below. In one embodiment, the transmission line 22 is a coaxial cable. In another embodiment, the transmission line 22 is formed of any manner of carrying power or data, including, for example, a twisted pair. In the case where the transmission line 22 is a coaxial cable it may include an inner conductor surrounded by a dielectric material. The coaxial cable may also include a shield layer that surrounds the dielectric material. In one embodiment, the shield layer is electrically coupled to an outer conductor that may be formed, for example, by a rigid or semi-rigid tube of a conductive material.

The segment 14 includes a downhole connection 24 and an uphole connection 26. The segment 14 is most commonly configured so that the uphole connection 26 is positioned at an uphole location relative to the downhole connection 24. The downhole connection 24 includes a male connection portion 28 having an exterior threaded section, and is referred to herein as a "pin end" 24. The uphole connection 26 includes a female connection portion 30 having an interior threaded section, and is referred to herein as a "box end" 26.

The pin end 24 and the box end 26 are configured so that the pin end 24 of one wired pipe segment 14 can be disposed within the box end 26 of another wired pipe segment 14 to effect a fixed connection therebetween to connect the segment 14 with another adjacent segment 14 or other downhole component to form a drill string. In one embodiment, the exterior of the male connection portion 28 and the interior of the female connection portion 30 are tapered. Although the pin end 24 and the box end 26 are described has having threaded portions, the pin end 24 and the box end 26 may be configured to be coupled using any suitable mechanism, such as bolts or screws or an interference fit.

In one embodiment, the system 10 is operably connected to a downhole or surface processing unit which may act to control various components of the system, such as drilling, logging and production components or subs. Other components include machinery to raise or lower segments 14 and operably couple segments 14, and transmission devices. The downhole or surface processing unit may also collect and process data generated by the system 10 during drilling, production or other operations.

As described herein, "drillstring" or "string" refers to any structure or carrier suitable for lowering a tool through a borehole or connecting a drill bit to the surface, and is not limited to the structure and configuration described herein. For example, a string could be configured as a drillstring, hydrocarbon production string or formation evaluation string. The term "carrier" as used herein means any device, device component, combination of devices, media and/or member that may be used to convey, house, support or otherwise facilitate the use of another device, device component, combination of devices, media and/or member. Exemplary non-limiting carriers include drill strings of the coiled tube type, of the jointed pipe type and any combination or portion thereof. Other carrier examples include casing pipes, wirelines, wireline sondes, slickline sondes, drop shots, downhole subs, BHA's and drill strings.

Figure 3:
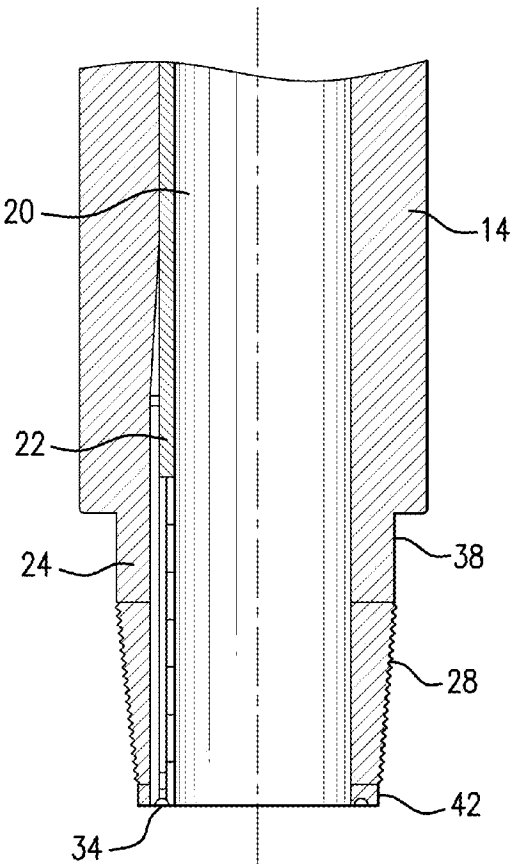
FIG. 3 depicts an exemplary embodiment of a pin connector of the segment of FIG. 1.
Figure 2:
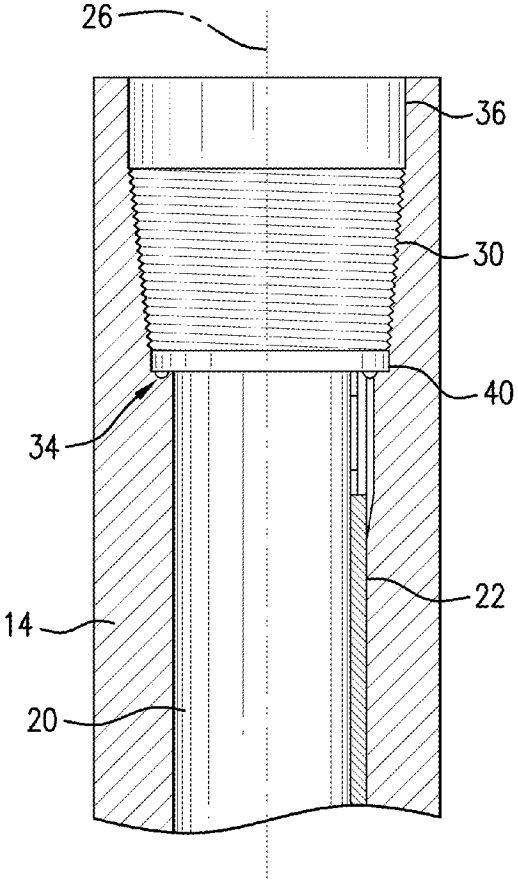
FIG. 2 depicts an exemplary embodiment of a box connector of the segment of FIG. 1.

Referring to FIGS. 2 and 3, the segment 14 includes at least one transmission device 34 (also referred to as a "coupler" herein) disposed therein and located at the pin end 24 and/or the box end 26. The transmission device 34 is configured to provide communication of at least one of data and power between adjacent segments 14 when the pin end 24 and the box end 26 are engaged. The transmission device 34 may be of any suitable type, such as an inductive coil, direct electrical (e.g., galvanic) contacts and an optical connection ring. The coupler may be disposed at the inner or outer shoulder. Further, the transmission device 34 may be a resonant coupler. It shall be understood that the transmission device 34 could also be included in a repeater element disposed between adjacent segments 14 (e.g, within the box end). In such a case, the data/power is transmitted from the transmission device in one segment, into the repeater. The signal may then be passed "as is," amplified, and/or modified in the repeater and provided to the adjacent segment 14.

Regardless of the configuration, it shall be understood that each transmission device 34 can be connected to one or more transmission lines 22. Embodiments disclosed herein are directed to how the transmission lines 22 can be formed and disposed in a segment 14. In one embodiment, the transmission line 22 is capable of withstanding the tensile, compression and torsional stresses and superimposed dynamic accelerations typically present in downhole tools when exploring oil, gas or geothermal wells. In one embodiment, a channel is formed in the segment 14 between the location of a portion of the transmission device 34 and the inner bore 20. The transmission line 22 is partially contained in the inner bore 20 and the channel. In one embodiment, the channel is gun drilled into the pipe segment 14.

In one embodiment, the transmission line 22 includes a wire channel (e.g., an outer protective layer) and a transmission element. The transmission element can be selected from one of coaxial cable, twisted pair wires, and individual wires. The following description is presented with respect to coaxial wire but it shall be understood that the teachings herein are applicable to any type of transmission element. In one embodiment, tension is created in the transmission element with respect to one or both the wire channel and the body of the segment 14. This tension may help to abate independent motion between the transmission element and the wire channel.

Figure 4:
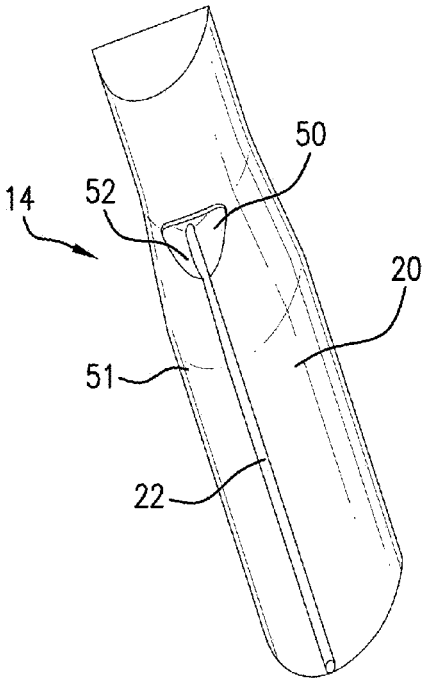
FIG. 4 shows a cut away perspective view of a wired pipe segment.

In FIG. 4 a perspective sectional view that shows details of portions on the inner bore 20 of pipe segment 14 is illustrated. The illustrated portions of the inner bore 20 could be near either the pin or box end of the segment 14. In FIG. 4, a transmission line 22 enters the inner bore 20 at an inlet 50. The transmission line 22 is located, least partially, within a transmission line channel that passes from the inner bore 20 through an outer wall 51 of segment 14. The inlet 50 is formed at the end the transmission line channel formed in the segment 14 that allows the transmission line 22 to be electrically coupled to a coupler (not shown) in one embodiment.

According to one embodiment, the transmission line 22 is mounted in a tensioned state in the bore 20. The manner in which the transmission line is held in a tensioned state can vary. A pocket 52 is formed adjacent the inlet 50. The pocket 52 is machined to reduce the mechanical tensions around the gun drilled hole that forms the inlet 50 in one embodiment.

In some cases, the pocket 52 can create a region of increased erosion caused by drilling mud pumped into the inner bore 20 during operation. Embodiments disclosed herein disclose a device ("an insert") that at least partially fills the pocket 52. In some cases, that can lead to a reduction in erosion in the inner bore 20 in pipe segments 14 that include a pocket such as pocket 52.

Figure 5:
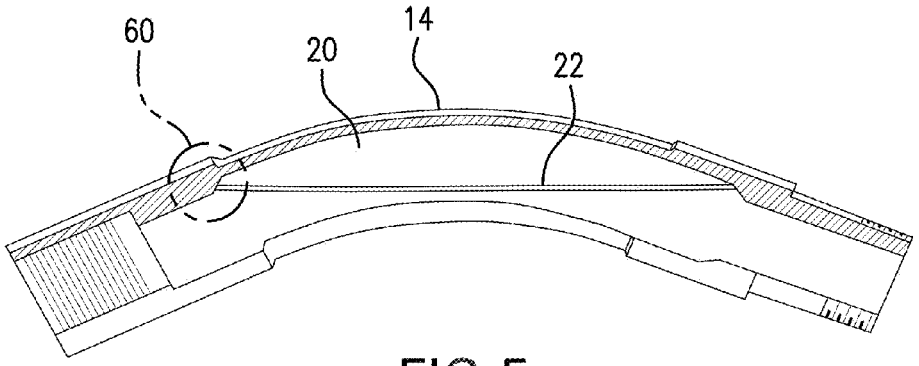
FIG. 5 shows a cut away perspective view of a bent wired pipe segment.

During drilling operations, an individual pipe segment 14 can be bent as is illustrated in FIG. 5. Such bending may occur, for example, during directional drilling. In a region 60 near where the transmission line 22 enters the inner bore 20, the transmission line 22 is sharply bent and this may lead to damage of the transmission line 22 in some instances. For instance, such a sharp bend may place repeated bending stresses on an outer protective (or conductive) cover of the transmission line 22. The insert disclosed herein may, in one embodiment, provide structural support to the transmission line that increases the radius of curvature of the transmission line 22 in region 60 when the segment 14 is bent.

Figure 6:
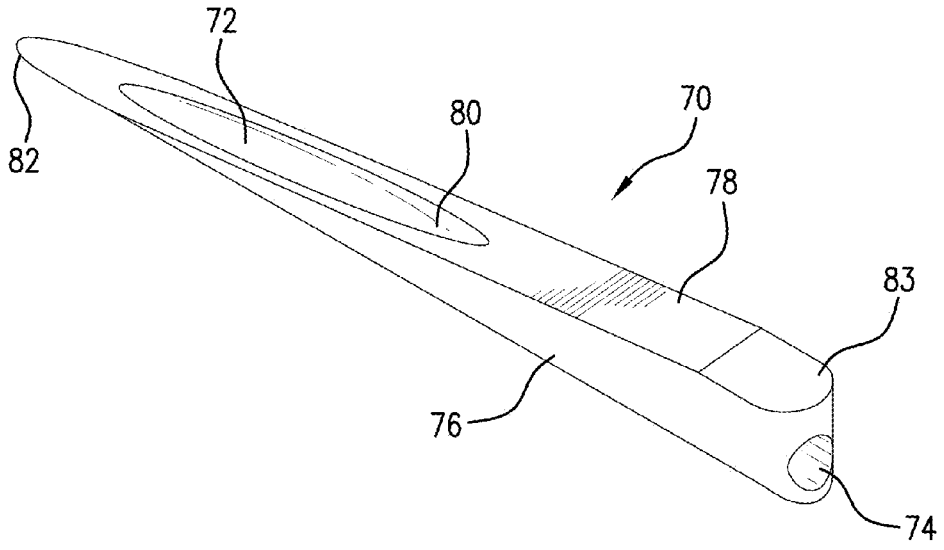
FIG. 6 shows a perspective view of an insert according to one embodiment.
Figure 7:
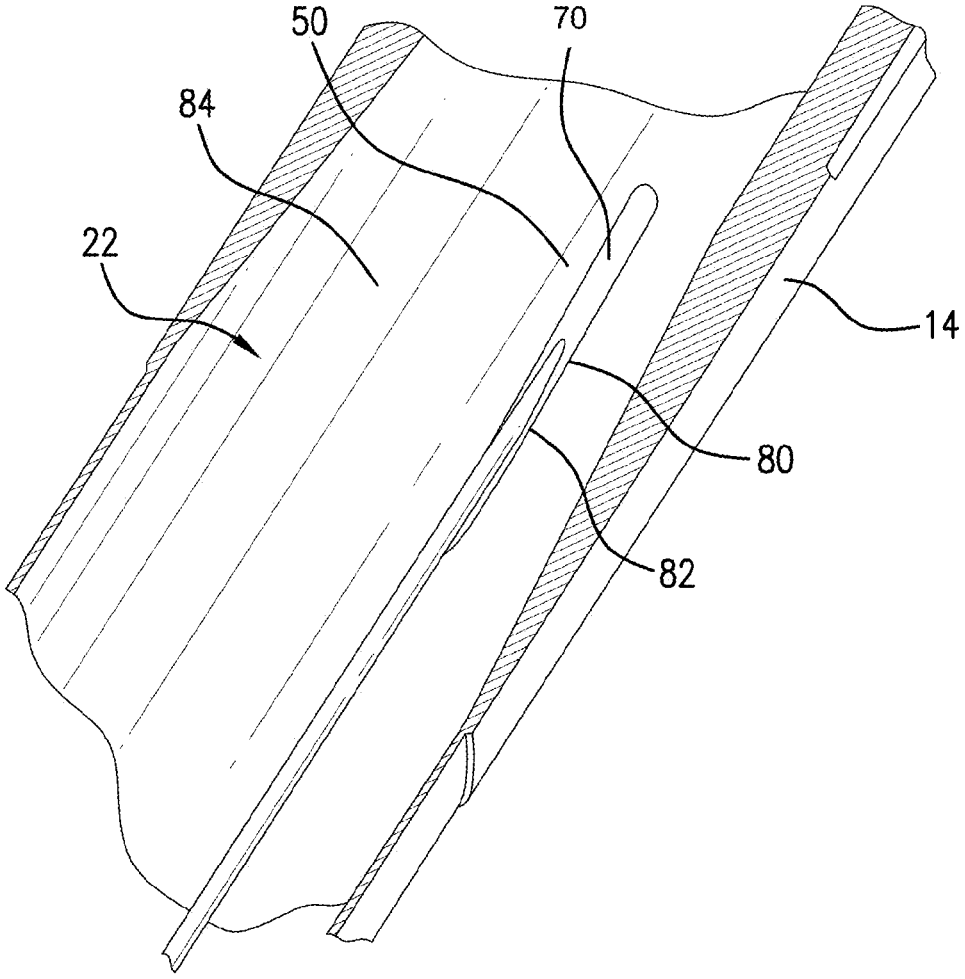
FIG. 7 shows the insert of FIG. 7 disposed in a wired pipe segment.

With reference now to FIGS. 4 and 6-7, FIG. 6 shows an example of an insert 70 according to one embodiment. The insert 70 is, in use, inserted into the pocket 52 in the inner bore 20 as illustrated in FIG. 7. The illustrated insert 70 includes a top 78 and a bottom 76. In this embodiment, the top 76 is shaped and configured such that it forms a substantially flat surface with the inner wall 84 of the inner bore 20 when inserted into the pocket 52. In one embodiment, the top 76 of the insert 70 is substantially flush with the inner wall 84.

The insert also includes a first end 82 and second end 83. The second end 83 is disposed in the pocket 52 such that it is proximate the inlet 50. A portion 72 of the first end 82 is located between the inner wall 84 and the transmission line 22 when the insert 70 and transmission line 22 are placed into the pocket 52.

The transmission line 22 enters the insert 70 at insert inlet 80 and exits the insert 70 and insert outlet 74. In one embodiment, the insert outlet 74 is aligned with the inlet 50 such that the transmission line 22 may enter the inlet 50.

The insert 70 may be formed of any suitable material such as rubber, plastic, polytetrafluoroethylene or steel. The insert 70 may be retained in the pocket 52 by an interference fit or by an adhesive.

While the invention has been described with reference to example embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the claims.

What is claimed is:

1. A wired pipe segment, comprising:

an inner bore extending through the wired pipe segment;

a transmission line channel forming a channel from outside the wired pipe segment to the inner bore and including an inlet into the inner bore;

wherein the inner bore includes a pocket formed in the inner bore proximate the inlet; and an insert disposed in the pocket that substantially fills the pocket and located completely within the bore and including first and second ends, the insert contacting fluids in the inner bore during operation and configured such that the insert completely surrounds a transmission line that passes through the transmission line channel and the inner bore, wherein the transmission line enters the insert at an insert inlet and exits the insert at an insert outlet and wherein the insert inlet is separated from both the first and second ends.

2. The wired pipe segment of claim 1, wherein the insert is formed of rubber, plastic, polytetrafluoroethylene or steel.

3. The wired pipe segment of claim 1, wherein the insert is substantially flush with a wall that defines the inner bore.

4. The wired pipe segment of claim 1, wherein the insert is fixed in the pocket by an interference fit.

5. The wired pipe segment of claim 1, wherein the insert is fixed in the pocket by an adhesive.

6. The wired pipe segment of claim 1, wherein the insert includes a first end and a second end, the second end being partially disposed in the pocket and the first end being at least partially located between an inner wall of the inner bore and a transmission line.

7. The wire pipe segment of claim 1 wherein the insert outlet is located proximate the inlet into the inner bore.

* * * * *